US005359983A

United States Patent [19]

Peck

[11] Patent Number: 5,359,983

[45] Date of Patent: Nov. 1, 1994

[54] BOW STRING RELEASE

[75] Inventor: Paul L. Peck, Fond du Lac, Wis.

[73] Assignee: Tru-Fire Corporation, North Fond du Lac, Wis.

[21] Appl. No.: 23,240

[22] Filed: Feb. 25, 1993

Related U.S. Application Data

[63] Continuation of Ser. No. 805,876, Dec. 9, 1991, abandoned, which is a continuation of Ser. No. 536,426, Jun. 11, 1990, Pat. No. 5,070,854.

[51] Int. Cl.[5] ..... F41B 5/18

[52] U.S. Cl. ..... 124/35.2

[58] Field of Search ..... 124/35.2, 35.1

[56] References Cited

U.S. PATENT DOCUMENTS

| | | | |
|---|---|---|---|
| 2,488,597 | 11/1949 | Konold | 124/35.2 |
| 2,819,707 | 1/1958 | Kayfes et al. | 124/35.2 |
| 2,936,749 | 5/1960 | Chellstorp | 124/35.1 |
| 3,921,615 | 11/1975 | Dodge | 124/35.2 |
| 4,036,204 | 7/1977 | Scott | 124/35.2 |
| 4,160,437 | 7/1979 | Fletcher | 124/35.2 |
| 4,282,851 | 8/1981 | Lyons | 124/35.2 |
| 4,407,260 | 10/1983 | Lyons | 124/35.2 |
| 5,020,508 | 6/1991 | Greene | 124/35.2 |
| 5,067,472 | 11/1991 | Vogel et al. | 124/35.2 |

*Primary Examiner*—Randolph A. Reese
*Assistant Examiner*—John A. Ricci
*Attorney, Agent, or Firm*—Robert C. Curfiss

[57] ABSTRACT

A bow string release includes elongate, cylindrical sears adapted for linear, axial movement into and out of a string retaining notch, the sears having ends which for a string centering retainer when in the closed, string retaining position. The latch system is designed to engage the sears below their center lines to minimize trigger travel. A trigger with a cam actuator is provided to further minimize trigger travel.

3 Claims, 2 Drawing Sheets

FIG. 1
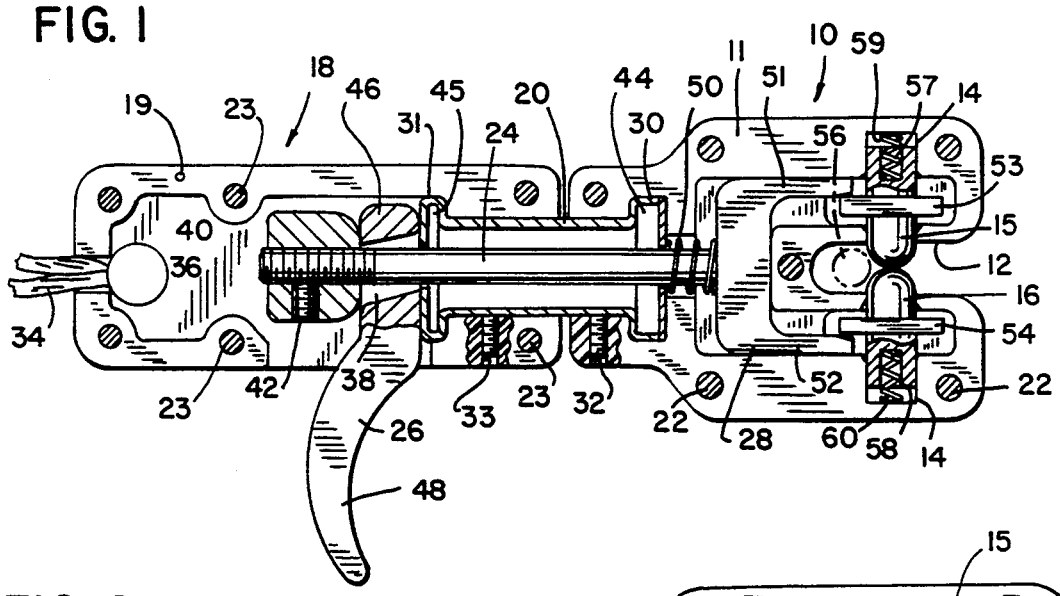
FIG. 2
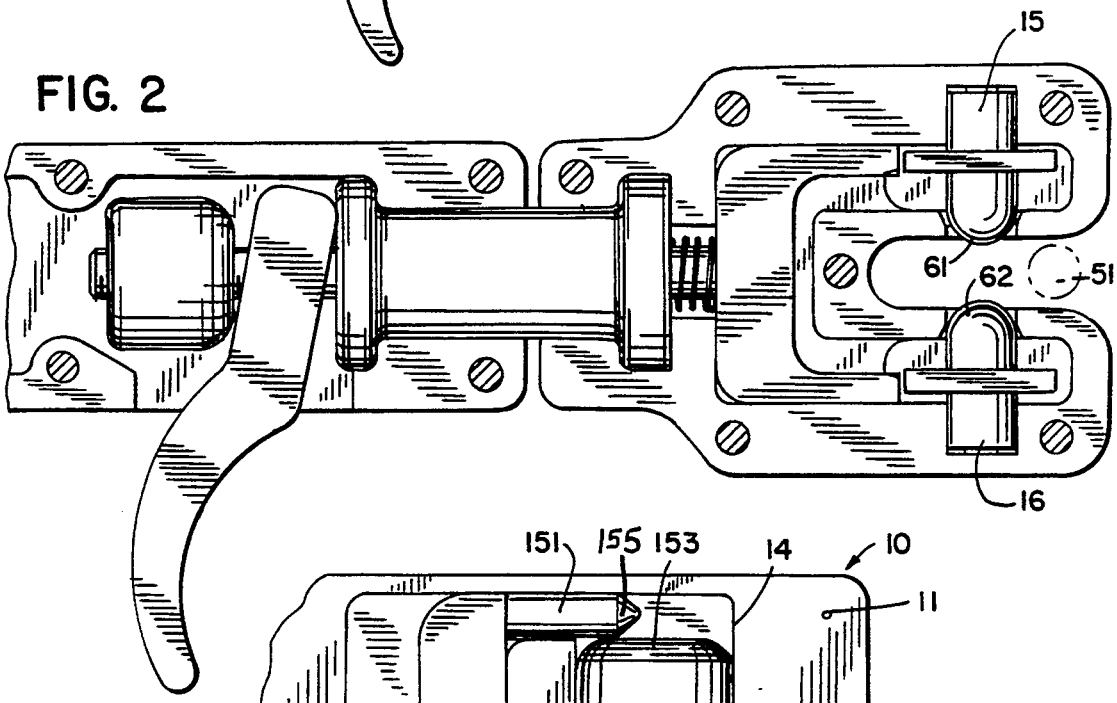
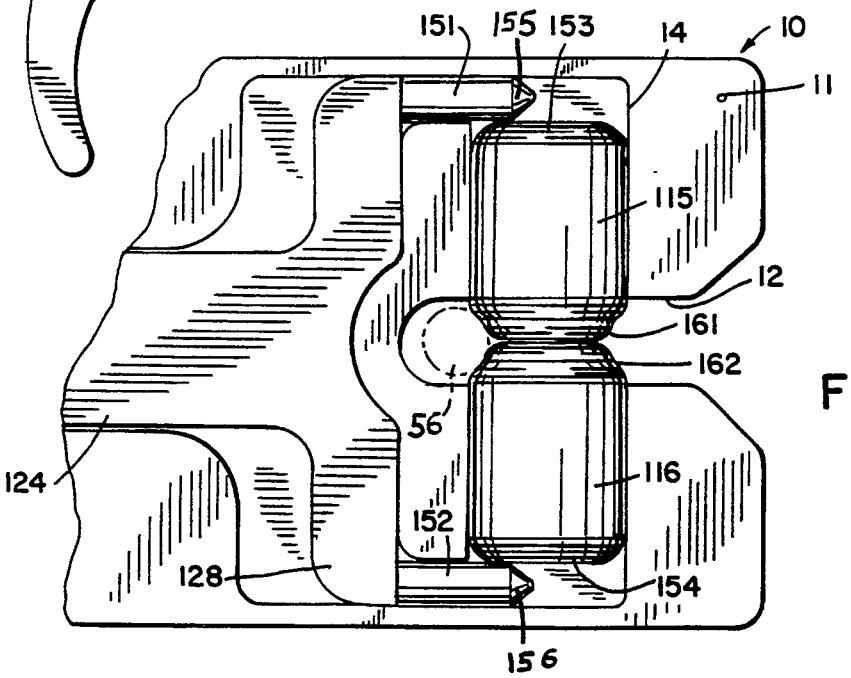
FIG. 3

BOW STRING RELEASE

This application is a continuation of application Ser. No. 07/805,876 filed Dec. 9, 1991 by Paul L. Peck, now abandoned, which is a continuation of application Ser. No. 07/536,426 filed Jun. 11, 1990 by Paul L. Peck now U.S. Pat. No. 5,070,854.

BACKGROUND OF THE INVENTION

This invention relates to bow string releases of the type having a releasable sear for retaining a bow string, the sear including a pair of elements adapted for linear movement into and out of a closed position to retain the bow string. Related applications filed by the same inventor are Ser. No. 07-518,957 filed on May 4, 1990 now U.S. Pat. No. 5,076,251 and Ser. No. 07-805,877, filed on Dec. 9, 1991, now U.S. Pat. No. 5,263,466.

Bow string releases have grown in popularity for target shooting and for hunting. A good release provides uniform release of the bow string and increases accuracy. The release is either hand-held or strapped to the wrist and has a trigger which permits the archer to release the string. Typically such devices employ a pivotal finger that engages the bow string, the finger being pivoted to a release position for releasing the string. Releases of this type are illustrated in U.S. Pat. Nos. 4,066,060; 3,898,974; and 3,954,095. It is known to use ball elements in place of the pivotal finger to retain and release the string, wherein the ball elements are held by a head and retained in position by a yoke or sleeve. A device of this type is illustrated in U.S. Pat. No. 4,403,594. While it is recognized that when the balls are separated by the tension of the string this provides minimal frictional engagement and a quiet release. Further, the balls do not produce a lateral bias on the string. However, this type of release has a significant disadvantage in that the amount of movement required to release the string is excessive when compared to the more common pivotal releases.

SUMMARY OF THE INVENTION

The bow string release of the present invention provides linear traveling sear elements which permit minimum movement of the latch to release the string. In addition, one embodiment of the invention provides a string retaining structure which conforms to the shape of the string, thereby reducing deformation and stress on the bow string when it is held by the release. This design takes advantage of the superior features of linear travel sear mechanisms while retaining the advantages of short stroke trigger releases such as the pivotal latches shown in the aforementioned application. In particular, the present invention includes an elongate, cylindrical sear mounted in the release head for linear or axial travel into and out of a string retaining notch. The cylindrical structure permits a latch yoke to engage and hold the sear below its center line, thus reducing the amount of travel required of the yoke in order to release the sear elements and the string. This permits the trigger to have a travel and a "feel" similar to that of pivotable bow string releases while taking advantage of the features of linear motion sear elements.

An additional feature of the invention is the cam trigger release, which provides a mechanical advantage over known pivotal lever releases. By employing a cam actuator on the trigger, a controlled travel ratio can be achieved between trigger travel and latch travel. This further reduces the amount of trigger travel required to release the bow string. It will be understood that this feature of the invention can be utilized in any number of bow release designs and is not limited to a release combined with the other features of the present invention.

These and other advantages will be more readily understood by reference to the drawings and detailed description which follow.

DESCRIPTION OF THE DRAWINGS

FIG. 1 illustrates the bow string release of the present invention, with the covers removed and the sear elements in the closed position.

FIG. 2 is an enlarged view of the release of FIG. 1, with the sear elements in the opened position.

FIG. 3 is an enlarged fragmentary view of a release, looking in the same direction as FIG. 2, showing alternate sear elements.

DETAILED DESCRIPTION OF THE INVENTION

Figure 4:
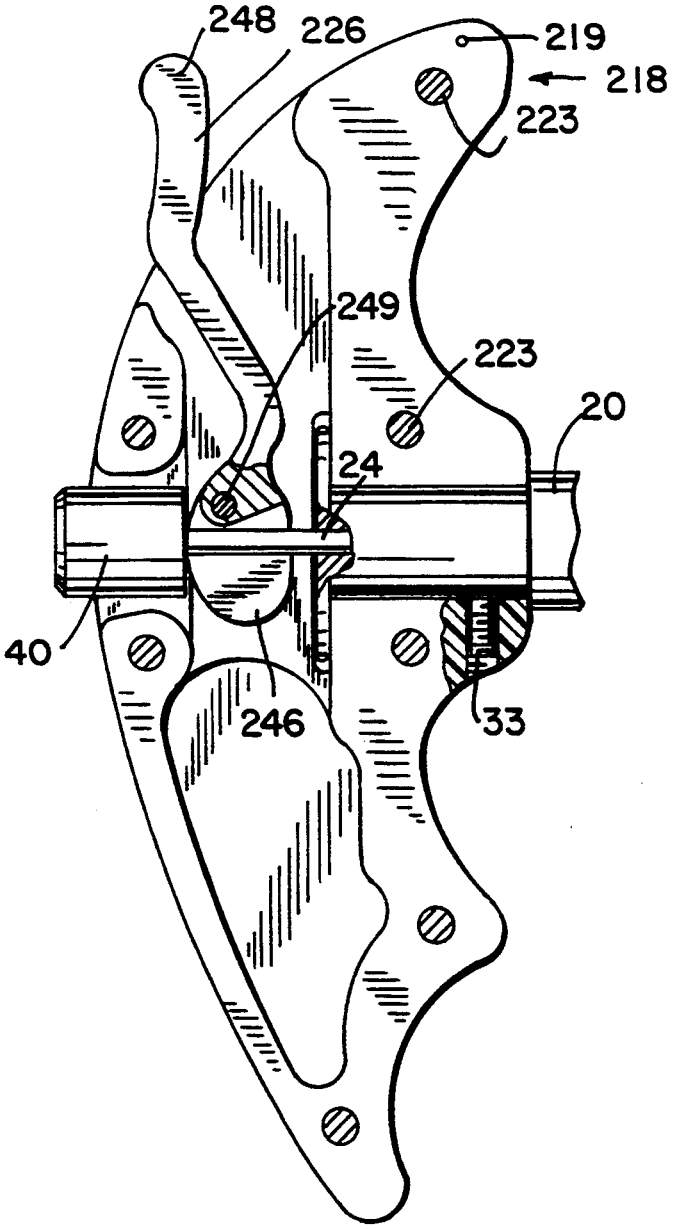
FIG. 4 is a fragmentary view of a release, looking in the same direction as FIG. 2, showing an alternate trigger release mechanism.

As shown in FIG. 1, the bow string release includes a head 10 including a string retaining notch 12 and a sear receiving channel 14 for slidably receiving and retaining a pair of sear elements 15 and 16.

The release body 18 is rotatably mounted relative to the head 10 on shaft 20. In the illustrated configuration, the head 10 and body 18 each may comprise a unitary molded base 11 and 19, respectively, each with suitable recesses and cavities to receive the various internal elements of the release. A molded cover, removed for clarity, is secured to each respective base at posts 22, 23 to maintain the release in its assembled state.

As shown, the shaft 20 is hollow to receive pin 24 for communicating the trigger 26 in the body and the latch yoke 28 in the head. The shaft includes enlarged ends 30, 31, received by suitable cavities in the head and body, respectively, for securing the head and body to the shaft when the covers are mounted on their respective bases. Both the head and body are rotatable about the shaft so that the sear elements and trigger may be oriented relative to one another to accommodate the individual needs of each user. Set screws 32, 33 are provided to lock the head relative to the body in the desired setting. The body 18 can be of any desired configuration such as the palm-type shown in FIG. 1 with a suitable wrist strap 34 held in place between the base and cover by retainer 36, or the hand-held thumb-release, as shown in FIG. 4.

The trigger 26 is pivotally carried in the head and includes a through hole 38 for receiving the pin 24. An adjustable stop-knob 40 is provided on the threaded end of the pin and may be adjusted relative to the trigger to fine-tune the travel stroke required to release the sear elements. A set screw 42 is provided to maintain the knob 40 in position. Bearing surfaces such as washers 44 and 45 are provided in the enlarged ends 30, 31 of the shaft 20 to slidably carry the pin 24. The actuator end 46 of the trigger is carried between shaft end 31 and knob 40, whereby movement of the trigger finger 48 to the left (as shown) pulls the pin 24 and yoke 28 to release the sear elements 15, 16 (see FIG. 2). A compression spring 50 may be provided between spool end 30 and yoke 28 to normally bias and urge the pin, yoke and trigger into the closed position (FIG. 1).

As particularly shown in FIGS. 1 and 2, the latch mechanism comprises a yoke 28 which is a generally "U" shaped member termating in a pair of legs 51 and 52 in communication with the sear elements 15 and 16, respectively. The pin 24 is connected to the base of the yoke. The sear elements 15 and 16 each include a raised, annular ring 53 and 54, respectively, located intermediate the ends of the sear element and adapted to receive and engage the respective leg of the yoke. This structure permits minimum contact between the yoke legs 51, 51 and the rings 53, 54 allowing for minimum travel of the yoke in order to release the sear elements 15 and 16. When the trigger 26 is pulled, moving the pin and yoke against spring 50, the legs 51 and 52 release rings 53, 54 and the tension on the bow string 56 (in phantom) separates the sear elements to release the string, as shown in FIG. 2.

A hollow cavity 57, 58 is provided in each sear 15, 16 for receiving a compression spring 59, 60, normally biasing and urging the sear elements into the closed position, permitting the sear elements, yoke, pin, and trigger to return to the closed position once the string is released. In order to reload, the trigger is pulled to release the sears and the string is reinserted in the notch, afterwhich release of the trigger returns the various moving elements to the locked, string retaining position, When closed, the two outer ends 61, 62 of the sears 15, 16 are in abutting relationship to retain the string in the notch 12. As shown in FIGS. 1 and 2, the abutting ends may be spherical in shape to provide a string retaining "V" similar to that of known ball-type releases.

An alternative is illustrated in FIG. 3, where the abutting ends of the sear elements 115, 116 are concave tapered surfaces 161, 162, respectively, conforming generally to the periphery of the string 56 when in the abutting, closed position. This reduces deformation and fatigue of the string when it is retained in the release. As the string is pulled, a portion of the string length will conform around the surfaces 161, 162. As shown in FIG. 3, the pin 124 and yoke 128 are an integral member with cylindrical legs 151, 152 extending therefrom to contact and engage the elongate, cylindrical sear elements 115, 116. Each sear element 115, 116 includes a tapered or rounded end portion 153, 154 to receive the legs 151, 152, respectively. A conical point 155, 156 is provided on each yoke leg 151, 152. By properly mating the taper or radius 153, 154 with the point 155, 156, the sear elements are self-locking without the aid of a sear spring (as shown at 59 and 60 of FIG. 1). The return of pin 124 and yoke 128 to the closed position will permit tapers 153 and 154 to ride on points 155 and 156, returning the sear elements to the closed position. As in the embodiment of FIG. 1, the sear elements of FIG. 3 can be engaged at a point below their center line axis to reduce travel required to the latch yoke and trigger.

The trigger stroke can be further modified by using the trigger arrangement illustrated in FIG. 4. As there shown, the body 218 comprises a hand grip made up of a base 219 and a cover (not shown) which is suitably secured on posts 223. The body is mounted for rotation on shaft 20, as previously described, and includes a set screw 33 to maintain it in proper orientation to the head. The pin 24 is carried, as before, in the hollow shaft 20 and includes a stop knob 40 at its outer end. The trigger 226 includes a thumb lever 248 and an eccentric cam actuator 246. The trigger is mounted for pivotal motion at post 249, with the cam surface 246 in contact with the stop 40 of the pin 24. By using the cam actuator surface, a mechanical advantage is provided where the movement is translated to pin 24 by movement of lever 248. The shape of the cam surface can be designed to provide any desired trigger stroke and force to release the bow string, regardless of the length of latch travel required and regardless of the length of the trigger lever.

While certain embodiments and features of the invention are described herein, it will be understood that the invention encompasses all embodiments and modifications within the scope and spirit of the following claims.

What is claimed is:

1. A bow string release comprising a pair of opposed sears each having an outer end including a smooth, rounded surface for nesting and releasing a bow string along its length and periphery, the outer ends movable in a linear motion between a closed position and an open, separated position and a trigger actuator engaging at least one of the sears and operable between a first, engaged position for maintaining the sears in the closed position for retaining a bow string and a second, actuated position permitting the sears to move to the separated position for releasing the string, the outer ends of the sears each contoured to form a string retaining surface conforming substantially to both the periphery of the string when in the closed position and the shape of the string along its length.

2. The bow string release of claim 1, wherein the outer ends of the sears are concave contoured in the plane orthogonal to the axis of the string to substantially define a portion of an arc when in the closed position.

3. The bow string release of claim 1, wherein the outer ends of the sears are cylindrical in the plane parallel to the length of the string for nesting the string when the sears are closed and the string is pulled to a drawn position.

* * * * *